United States Patent [19]

Van Dyk

[11] 4,429,428

[45] Feb. 7, 1984

[54] FLUID EJECTED AND RETRACTED TUBE CLEARANCE TESTER

[76] Inventor: Steven G. Van Dyk, 45-631 Kapunahala Rd., Kaneohe, Hi. 97644

[21] Appl. No.: 314,806

[22] Filed: Oct. 26, 1981

[51] Int. Cl.[3] ..... B08B 9/02

[52] U.S. Cl. ..... 15/3.52; 15/104.06 A; 254/134.4

[58] Field of Search ..... 15/3.52, 104.06 R, 104.06 A; 254/134.4

[56] References Cited

U.S. PATENT DOCUMENTS

| | | | |
|---|---|---|---|
| 721,889 | 3/1903 | Henderson et al. | 15/3.52 |
| 956,668 | 5/1910 | Becker | 15/3.52 X |
| 1,999,559 | 4/1935 | Brendlin | 15/3.52 X |
| 2,470,338 | 5/1949 | Chilton | 15/3.52 X |
| 2,930,584 | 3/1960 | Hensley et al. | 15/3.52 X |
| 3,034,766 | 5/1962 | Hamrick | 254/134.4 |
| 3,052,451 | 9/1962 | Hamrick | 254/134.4 |
| 3,179,375 | 4/1965 | Hamrick | 254/134.4 |

*Primary Examiner*—Edward L. Roberts

*Attorney, Agent, or Firm*—R. F. Beers; Ervin F. Johnston

[57] ABSTRACT

A tube blockage tester or a blockage eliminator is provided which includes a manifold which has a forward end and a rearward end. A nozzle is provided at each end of the manifold with one of the nozzles being directed forwardly and the other nozzle being directed rearwardly. The manifold is adapted to receive a fluid pressure supply line. A valve is mounted in the manifold for selectively controlling pressurized fluid to the nozzles. A reel, which has a line reeled thereon, has a plurality of vanes around its circumference. The reel is mounted on the manifold aft thereof with the vanes of the reel in the path of the rearward nozzle so that when fluid is ejected from the rearward nozzle the reel will wind the line thereon. A probe is provided which is capable of slipping into the tube and the line is connected to the probe. With this arrangement the forward nozzle can be operated by the valve to force the probe through the tube and the rearward nozzle can be operated to retract the probe by winding the line on the reel.

7 Claims, 4 Drawing Figures

FIG. 1
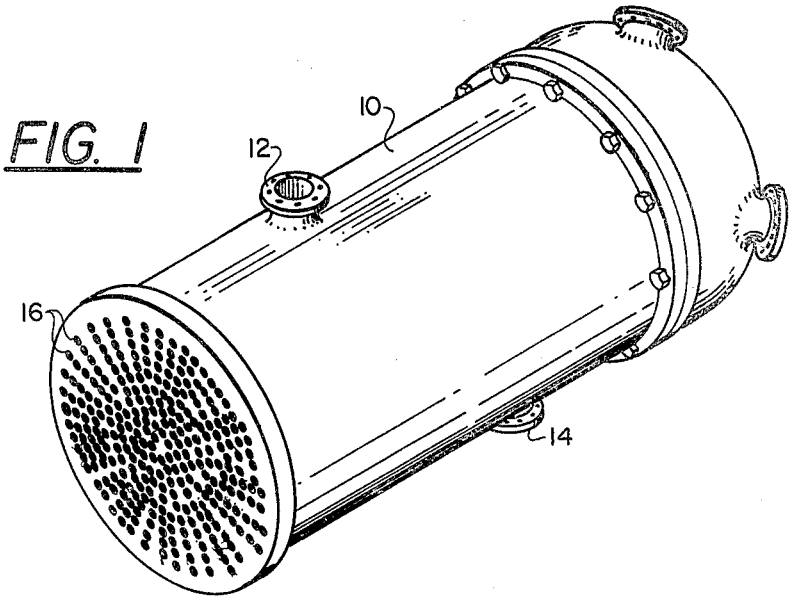
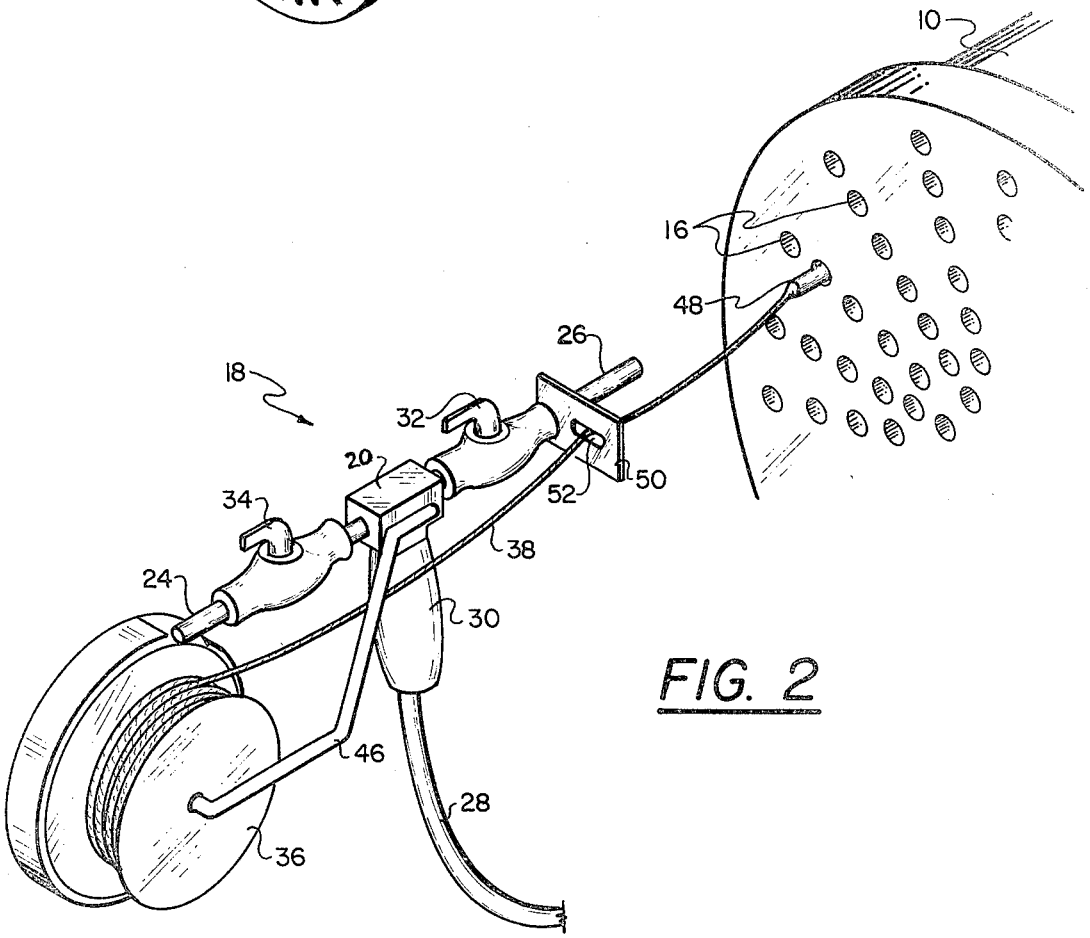
FIG. 2

FLUID EJECTED AND RETRACTED TUBE CLEARANCE TESTER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention relates to a device for testing the blockage of a tube, or alternately eliminating the blockage within the tube.

One of the major areas of ship repair is the cleaning of condenser tubes which become blocked from seawater growth. After a few months, and sometimes as short as one month, sea growth in the inside of the tubes starts to affect the performance of the main condenser by narrowing the tubes and constricting the flow of water therethrough. This causes the condenser to become less and less efficient in cooling steam coming from the main turbines of the ship.

The most thorough method used to clean out main condenser tubes is a hydro-blast method. This method uses a high pressure gun which directs a stream of water into each tube. After the hydro-blast is completed the tubes are checked one at a time to see which tubes are still clogged. The present method of checking for a clogged tube is to pneumatically force a probe attached to a cable into the tube. If the probe runs the entire length of the tube the tube is considered clear of any blockage. The probe is then pulled back by hand using the attached cable. This process is repeated for each of the many tubes, such as two thousand tubes in a main condenser for a large ship or submarine.

The problems with the present method of checking blockage within a tube are that the probe must be pulled out by hand each time, the cable connected to the probe invariably becomes tangled as it is laid on the deck, and kinks in the cable prevent air from pushing the probe through smoothly. Because of the voluminous number of tubes which must be checked in any main condenser there has been a long existing need for a more efficient way of checking tube blockage.

STATEMENT OF THE INVENTION

The present invention provides a significantly improved method of checking tube blockage. This has been accomplished by providing a manifold which has a forward end and a rearward end. A nozzle is provided at each end of the manifold with one of the nozzles being directed forwardly and the other nozzle being directed rearwardly. The manifold is adapted to receive a fluid pressure supply line. A valve is mounted in the manifold for selectively controlling pressurized fluid to the nozzles. A reel, which has a line reeled thereon, is provided with vanes around its circumference. The reel is mounted on the manifold aft thereof with the vanes of the reel in the path of the rearward nozzle so that when fluid is ejected from the rearward nozzle the reel will wind the line thereon. A probe is provided which is capable of slipping into the tube, and the line is connected to the probe. With this arrangement the forward nozzle can be operated by the valve to force the probe through the tube and the rearward nozzle can be operated to retract the probe by winding the line on the reel. The blockage tester device can be operated at a very fast rate, thus saving a considerable amount of manhours and down time of the ship or submarine.

OBJECTS OF THE INVENTION

An object of the present invention is to provide a more efficient device for fluid driving a probe into a tube and withdrawing the probe therefrom with the probe readied for efficient operation on subsequent tubes.

Another object is to provide a tube blockage tester which is faster to operate and more efficient than prior art tube blockage testers.

A further object is to provide a hand held tube blockage tester which pneumatically operated through a valve device to quickly extend and retract a probe from the tube, and which is readied for efficient checking of subsequent tubes.

Still another object is to provide a tube blockage tester which utilizes a cable connected probe wherein the tester is faster to operate and the cable is prevented from kinking.

These and other objects of the invention will become more readily apparent from the ensuing specification when taken together with the drawings.

DESCRIPTION OF THE DRAWINGS

FIG. 1 is an isometric view illustrating a main condenser with its head removed so as to show its series of tubes therethrough.

FIG. 2 is an isometric view of a workman holding the present tube blockage tester in his hand with the tester readied to drive a probe into a condenser tube.

DESCRIPTION OF THE PREFERRED EMBODIMENT

Figure 3:
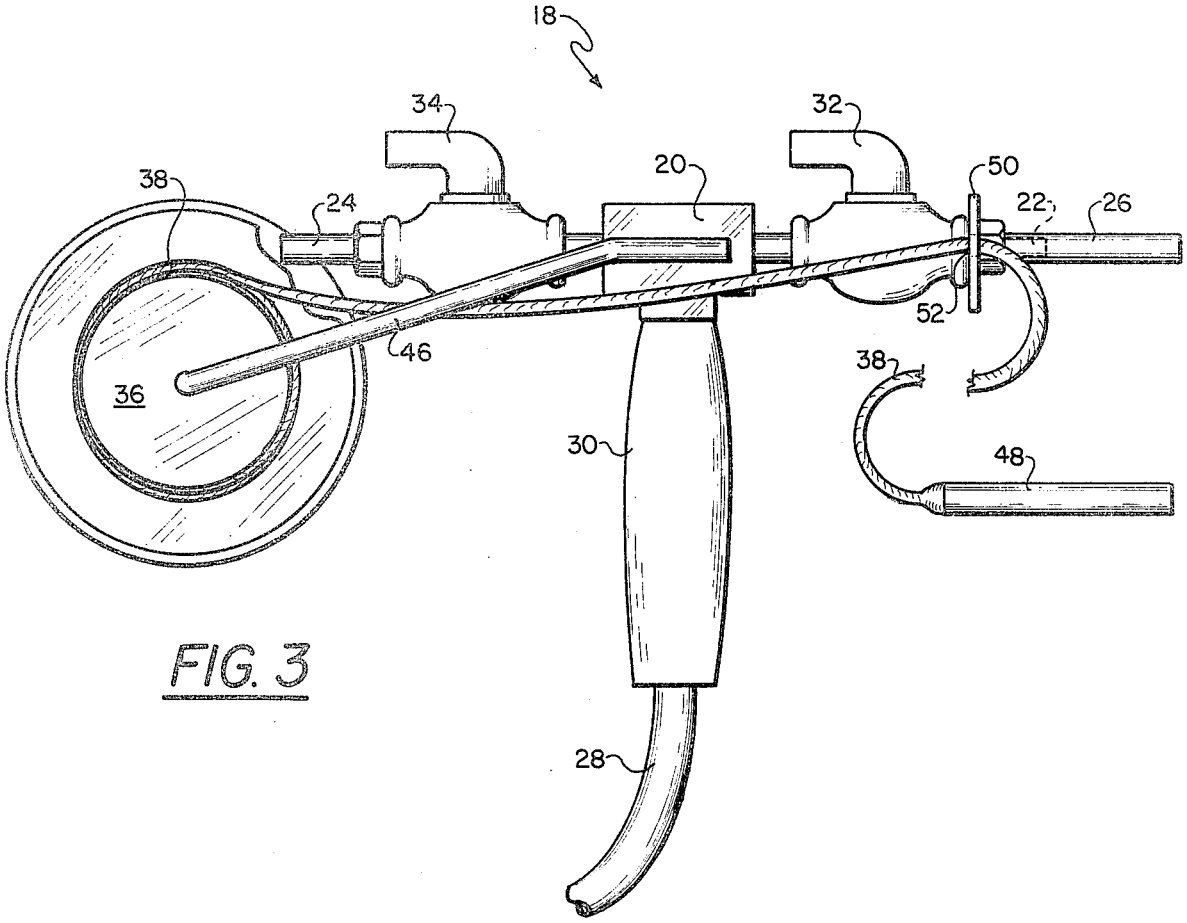
FIG. 3 is an isometric view of the present tube blockage tester.

Referring now to the drawings where like reference numerals designate like or similar parts throughout the several views there is illustrated in FIG. 1 a main condenser 10 which has an inlet 12 for receiving steam to be cooled, such as from a main turbine, and an outlet 14 which is utilized for discharging cooled fresh water. The left end of the main condenser has its head removed so as to show the plurality of tubes 16 which extend along the condenser from end to end. Each of these tubes 16 carry seawater from one end to the other so as to provide cooling for the steam entering the inlet 12. Because of the sea life in seawater these tubes periodically become blocked, sometimes as short as one month, thus rendering the main condenser ineffective. The main condensers for large ships or submarines have as many as 2,000 tubes which must be individually checked for blockage. The present invention provides an efficient device for checking a plurality of tubes in a short period of time.

Figure 4:
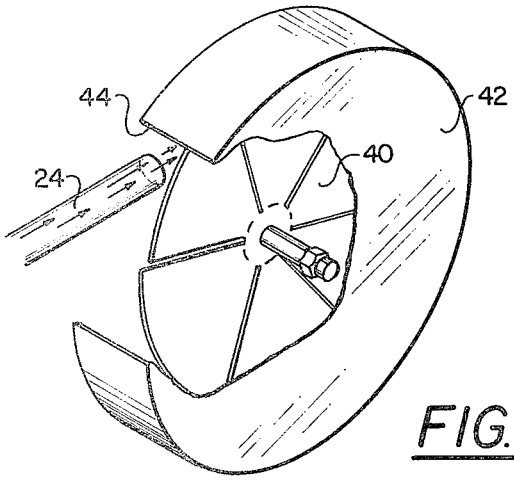
FIG. 4 is an isometric view of the reel portion of the present tube blockage tester with a portion cut away to illustrate details thereof.

The present invention is a tube blockage tester 18 which is illustrated in FIGS. 2 through 4. As illustrated in FIG. 3, the tube blockage tester includes a manifold 20 which has a forward end and a rearward end. A nozzle is located at each end of the manifold, one of the nozzles 22 being directed forwardly, and the other nozzle 24 being directed rearwardly. In the preferred embodiment the manifold 20 is elongated and the nozzles 22 and 24 extend along the longitudinal axis of the manifold. Further, a resilient hose 26 may be connected to the forward nozzle 22 with the hose sized to just snugly slide into one of the condenser tubes 16. This will enable the tester 18 to be operated successfully at various angles to the condenser tube, such as where the tester is being utilized in a confined space.

The manifold 20 is adapted to receive a fluid pressure supply line, such as a high pressure air line 28. The air line 28 may be connected to a bottom portion of the manifold and may extend downwardly therefrom perpendicularly to the longitudinal axis of the manifold. The connection may be made by any suitable means, such as a fitting (not shown). A handle 30 may be provided around the upper portion of the air hose 28 so that an operator may grasp the tube blockage tester 18 for hand operation.

A valve arrangement is mounted in or to the manifold for selectively controlling pressurized air to the nozzles 22 and 24. The valve arrangement may include an on-off valve 32 which is connected between the manifold 20 and the forward nozzle 22 and another on-off valve 34 which is connected between the manifold 20 and the rearward nozzle 24. The connection of these valves to the manifold 20 may be accomplished by any suitable means, such as fittings. Other valve arrangements would be suitable as long as they provide for alternate operation of discharging pressurized air through the forward nozzle 22 or the rearward nozzle 24. One such nozzle arrangement may include a trigger valve for the operator's hand to alternately supply pressurized air to one or the other of the nozzles 22 or 24.

The tube blockage tester 18 further includes a reel 36 which has a cable or line 38 reeled thereon. As best illustrated in FIG. 4, the reel has a plurality of vanes 40 which are located at one side thereof, and that side may be provided with a cowling 42 with an opening 44 for partially encompassing the vanes 40 and directing high pressurized air thereon. Means are provided for mounting the reel 36 on the manifold 20 aft thereof with the vanes 40 of the reel in the path of the rearward nozzle 24 so that when air is ejected from the rearward nozzle the reel will wind the line 38 thereon. As shown in FIGS. 3 and 4 the nozzle 24 is directed through the opening 44, and the reel is rotated by the impingement of ejected air on the vanes 40. The means for mounting the reel 36 on the manifold may include a bar 46 which is connected at one end to the manifold 20 and at the other end to the reel 36.

A probe 48 is provided which is capable of slipping into one of the tubes 16. The line 38 from the reel 36 is connected to a rearward end of the probe 48. As illustrated in the drawings the line 38 has a smaller cross-section than the probe 48. A plate 50 is mounted to the manifold 20 and extends laterally therefrom. The plate has an opening, such as aperture 52, which is sized to slidably receive the line 38, but is too small to allow the passage of the probe 48 therethrough. The plate 50 will thereby prevent the probe 48 from movement past its location on the tester device.

OPERATION OF THE INVENTION

As illustrated in FIG. 2 the invention is operated by placing the probe 48 into one of the tubes 16. The resilient hose 26 of the tester is then inserted into the tube 16 immediately behind the probe 48. Because of the resiliency of the hose 26 the line 38 can be easily moved in either direction, and yet a good seal is maintained between the hose 26 and the tube 16. Alternatively, the end of the hose 26 can merely be placed near the opening of the tube 16 to direct pressurized air into the tube. With the tester device held in one hand by the operator the operator uses his other hand to turn on the forward valve 32 causing high pressurized air to force the probe 48 into the tube. The length of the line 38 may be such that if its full length is utilized the operator will know that the probe 48 has passed all the way through the tube, The bitter end of the line 38 is of course connected to the reel 36 so that it will not be freed therefrom. If the probe 48 stops too soon in the tube there is an indication of blockage therein and measures must be taken to remove this blockage. To withdraw the probe the operator closes the valve 32 and opens the valve 34 which causes pressurized air to impinge on the vanes 40 and wind the line 38 back on the reel 36, thereby withdrawing the probe 48 from the tube. After the probe 48 comes out of the tube it is stopped by the laterally extending plate 50, after which the operator may close the valve 34. The tube blockage tester is then completely ready for a repeat operation within another tube 16, and so on until all 2,000 of the tubes in a large main condenser have been checked out. It should be realized that the present invention can be utilized for other purposes such as checking the clearance within a tube or even removing blockage within the tube by increasing the pressure of the air sufficiently.

Obviously, many modifications and variations of the present invention are possible in the light of the above teachings. It is therefore to be understood that within the scope of the appended claims the invention may be practiced otherwise than as specifically described.

What is claimed is:

1. A tube blockage tester or blockage eliminator comprising:

a manifold having a forward end and a rearward end;

a nozzle at each end of the manifold, one of the nozzles being directed forwardly and the other nozzle being directed rearwardly;

the manifold being adapted to receive a fluid pressure supply line;

valve means mounted in the manifold for selectively controlling pressurized fluid to the nozzles;

a reel with a line reeled thereon, said reel having vanes;

means mounting the reel on the manifold aft of the manifold with the vanes of the reel in the path of the rearward nozzle so that when fluid is ejected from the rearward nozzle the reel will wind the line thereon;

a probe which is capable of slipping into the tube; and the line being connected to the probe; and a resilient hose connected to the forward nozzle, said hose being capable of sliding into said tube after the probe is inserted therein so that the line can be projected into or withdrawn from the tube past said resilient hose when fluid is ejected into the tube or ejected onto the vanes of the reel, respectively;

whereby, upon connecting the fluid pressure line to the manifold, the forward nozzle can be operated by the valve means to force the probe through the tube and the rearward nozzle can be operated to retract the probe by winding the line on the reel.

2. A combination as claimed in claim 1 including:

said line having a cross-section which is smaller than the cross-section of the probe;

a plate mounted to the manifold and extending therefrom;

said plate having an opening which receives said line therethrough; and the plate opening being smaller thereacross than the probe.

3. A tube blockage tester or blockage eliminator comprising:

a manifold having a forward end and a rearward end;

a nozzle at each end of the manifold, one of the nozzles being directed forwardly and the other nozzle being directed rearwardly;

the manifold being adapted to receive a fluid pressure supply line;

valve means mounted in the manifold for selectively controlling pressurized fluid to the nozzles;

a reel with a line reeled thereon, said reel having vanes;

means mounting the reel on the manifold aft of the manifold with the vanes of the reel in the path of the rearward nozzle so that when fluid is ejected from the rearward nozzle the reel will wind the line thereon;

a probe which is capable of slipping into the tube; and the line being connected to the probe;

the fluid pressure line being connected to the manifold intermediate the nozzles;

the valve means including a forward on-off valve connected in the manifold between the fluid pressure line and the forward nozzle and a rearward on-off valve connected in the manifold between the fluid pressure line and the rearward nozzle;

the manifold being elongated with the nozzles extending along the longitudinal axis of the manifold;

a handle mounted to a bottom portion of the manifold and extending downwardly therefrom perpendicularly to said longitudinal axis; and the fluid pressure line extending longitudinally through the handle and being communicatively connected to the manifold through its bottom portion;

whereby, upon connecting the fluid pressure line to the manifold, the forward nozzle can be operated by the valve means to force the probe through the tube and the rearward nozzle can be operated to retract the probe by winding the line on the reel.

4. A combination as claimed in claim 3 including:

said line having a cross-section which is smaller than the cross-section of the probe;

a plate mounted to the manifold forward of the forward valve and extending transversely therefrom beyond the width of the manifold;

said plate having an opening which receives said line therethrough;

the plate opening being smaller thereacross than the probe; and the plate opening being substantially aligned with the reel so that line coming off the reel passes to one side of the handle.

5. A combination as claimed in claim 4 including:

a resilient hose connected to the forward nozzle, said hose being capable of sliding into said tube after the probe is inserted therein so that the line can be projected into or withdrawn from the tube past said resilient hose when fluid is ejected into the tube or ejected onto the vanes of the reel respectively.

6. A combination comprising:

an elongated manifold having a forward end and a rearward end;

a nozzle at each end of the manifold, one of the nozzles being directed forwardly and the other nozzle being directed rearwardly;

the manifold being adapted to receive a fluid pressure supply line;

valve means mounted in the manifold for selectively controlling pressurized fluid to the nozzles;

a reel for receiving a line thereon, said reel having vanes;

means mounting the reel on the manifold aft of the manifold with the vanes of the reel in the path of the rearward nozzle so that when fluid is ejected from the rearward nozzle the reel is capable of winding line thereon;

a probe which is capable of slipping into the tube; and the line being connected to the probe; and a resilient hose connected to the forward nozzle, said hose being capable of sliding into said tube after the probe is inserted therein so that the line can be projected into or withdrawn from the tube past said resilient hose when fluid is ejected into the tube or ejected onto the vanes of the reel, respectively.

7. A combination as claimed in claim 6 including:

a plate mounted to the manifold and extending therefrom; and said plate having an opening for receiving said line.

* * * * *